US005699319A

United States Patent [19]

Skrivervik

[11] Patent Number: 5,699,319

[45] Date of Patent: Dec. 16, 1997

[54] HORLOGICAL PIECE COMPRISING AN ANTENNA

[75] Inventor: Anja Skrivervik, Champvent, Switzerland

[73] Assignee: Asulab S.A., Bienne, Switzerland

[21] Appl. No.: 702,212

[22] Filed: Aug. 23, 1996

[30] Foreign Application Priority Data

Sep. 26, 1995 [FR] France ..... 95 11270

[51] Int. Cl.[6] ..... G04D 47/00; H05G 1/14

[52] U.S. Cl. ..... 368/10; 368/278; 343/718

[58] Field of Search ..... 368/10, 47, 276, 368/278; 343/718; 455/347, 348, 351

[56] References Cited

U.S. PATENT DOCUMENTS

| | | | |
|---|---|---|---|
| 3,228,030 | 1/1966 | Moore et al. . | |
| 4,884,252 | 11/1989 | Teodoridis et al. | 368/10 |
| 4,922,260 | 5/1990 | Gaskill et al. | 343/718 |
| 5,450,091 | 9/1995 | Hama | 343/718 |
| 5,589,840 | 12/1996 | Eujisawa | 343/718 |

FOREIGN PATENT DOCUMENTS

| | | |
|---|---|---|
| 382130 | 8/1990 | European Pat. Off. . |
| 673748 | 4/1990 | Switzerland . |

OTHER PUBLICATIONS

IBM Technical Disclosure Bulletin, vol. 36, No. 09A, Sep. 1993, Armonk, NY, USA, pp. 433–434, XP000396119, "Antenna On Flexible Carrier".

Patent Abstracts Of Japan, vol. 2, No. 32 (E–018), Feb. 28, 1978, & JP–A–52 152759 (Daini Seikosha K.K.), Dec. 19, 1977.

*Primary Examiner*—Vit W. Miska

*Attorney, Agent, or Firm*—Sughrue,Mion,Zinn,Macpeak & Seas, PLLC

[57] ABSTRACT

Horlogical piece intended to be worn on the wrist including either a dipole antenna (4) or a slot antenna (30; 40) and a first case (5) comprising organs (7, 8, 10) for displaying the time, and a micro receiver (6). The horlogical piece further comprises a second case (2) intended to receive the first case (5) such that the exterior surface of the first case and the interior surface of the second case defined a mounting slot (25). The antenna (4; 30; 40) comprises a dielectric substrate (13; 33; 43), and at least one printed circuit conductive element (11, 12; 31; 41) fixed the substrate (13; 33; 43).

In addition, the antenna (4; 30; 40) is located in the mounting slot (25) such that it is wound around the first case (5).

6 Claims, 5 Drawing Sheets

HORLOGICAL PIECE COMPRISING AN ANTENNA

The present invention concerns a horlogical piece intended to be worn on the arm or wrist, the piece including either a dipole antenna or a slot antenna adapted to receive and/or emit an electromagnetic field bearing radio diffused messages, a case comprising organs for affiching the time and a micro emitter receiver which receives or emits messages via the antenna.

Horlogical pieces equipped with a dipole antenna and a micro receiver for detecting radio diffused signals are already known. The patent U.S. Pat. No. 5,317,326 in the name of Motorola, Inc., for example, describes a horlogical piece having the form of a wrist-watch which includes a folded dipole antenna housed in the bracelet.

Placing the antenna in the bracelet of a watch poses problems in the connection between the emitter receiver which is located in the case of the watch in the antenna which forms an integral part of the bracelet. The passage of the conductive elements connecting the antenna to the receiver across the case thus poses construction problems which lead to solutions which are never simple. In addition, at the location of this passage, the conductive elements are mechanically solicited in a near continuous meaner when the watch is worn and break relatively quickly, if means are not put in the place to avoid this rupture. These means are moreover burdensome and complicated the operation of changing the bracelet, this later having to be especially fabricated since the bracelet includes an antenna and can therefore not be replaced by a currently existing bracelet on the market.

Attempts have nevertheless been made to resolve this problem. Thus, the English abstract of the document JP-A-52-48364 which appeared in "Patent Abstracts of Japan", vol. 1, No 116, 4 Oct. 1977, page 4486 E 77, describes an horlogical piece which comprises a micro receiver and an antenna in the case of a watch intended to be worn by a person. This horlogical piece includes two crystals fixed to each other. The antenna, of a single wire type, is interposed between this two crystals.

However, locating in the antenna in the case of a watch require the miniaturisation of the antenna due to the very limited space which is available for the mounting of the antenna. If it is possible to reduce to a certain extent the dimension of the antenna for a given frequency, this will be to the detriment of it other characteristics, such as the gain or the pass band. At a fixed frequency, a miniature antenna will thus have a gain and a pass band which are smaller than that of an antenna of normal size located in a bracelet.

Thus, the present invention has as object to supply a horlogical piece of the type defined here above which ameliorates the inconvenients of the prior art.

Another aim of the invention is to supply such a horlogical piece whose antenna as such, as well as its electric dimensions, are optimales.

In addition, an aim of the invention is to supply such a horlogical piece in which the construction of the antenna and its mounting in the case are simple and the construction is moreover uncumbersome.

To this effect, the present invention provides a horlogical piece intended to be worn on the wrist, this piece including a dipole antenna or a slot antenna adapted to receive and/or transmit an electromagnetic field bearing radio diffused messages, a first case including organs for displaying the time and a micro emitter receiver which receives or emit messages via the antenna. The horlogical piece is characterised by the fact that it further comprises a second case intended to receive the first case such that the exterior surface of the first case and the interior surface of the second case define a mounting slot, and in that the antenna comprises a dielectric substrate and at least one printed circuit conductive element fixed to the substrate and which defindes a radiating element of the antenna and the antenna is located in the mounting slot such that it is wound around the first case.

Thanks this combination of characteristics, the antenna may be, firstly, manufactured independently of the other elements of the horlogical piece. Furthermore, the antenna may be easily located in this horlogical piece during its assembly so as to benefit from the inherent dimensions of the horlogical piece to optimise the electric dimensions of the antenna.

According to one embodiment to the invention, the horlogical piece further comprises a mass located in the mounting slot, between the antenna and the exterior surface of the first case such that it surrounds this case.

Thus, the antenna may be electrically isolated from perturbing elements which are located inside the horlogical piece.

Other characteristics and advantages of the invention more clearly from the reading of the detail description is follows, made with reference to the annexe drawings, representing, as in example only, different embodiments of the horlogical piece of the invention and in which.

Figure 1:
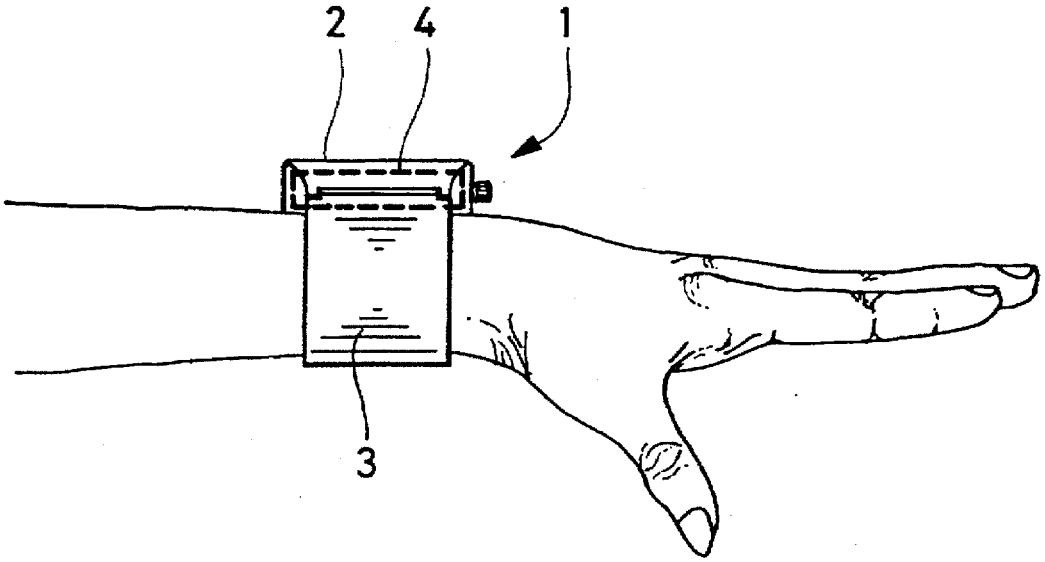
FIG. 1 shows a wrist bearing a horlogical piece according to the present invention.

FIG. 1 represents in schematic manner a fore-arm bearing a wrist watch 1 including a case 2 and a bracelet 3. To detect an electromagnetic field bearing radio diffused messages, the case 2 contains an antenna 4.

Figure 2:
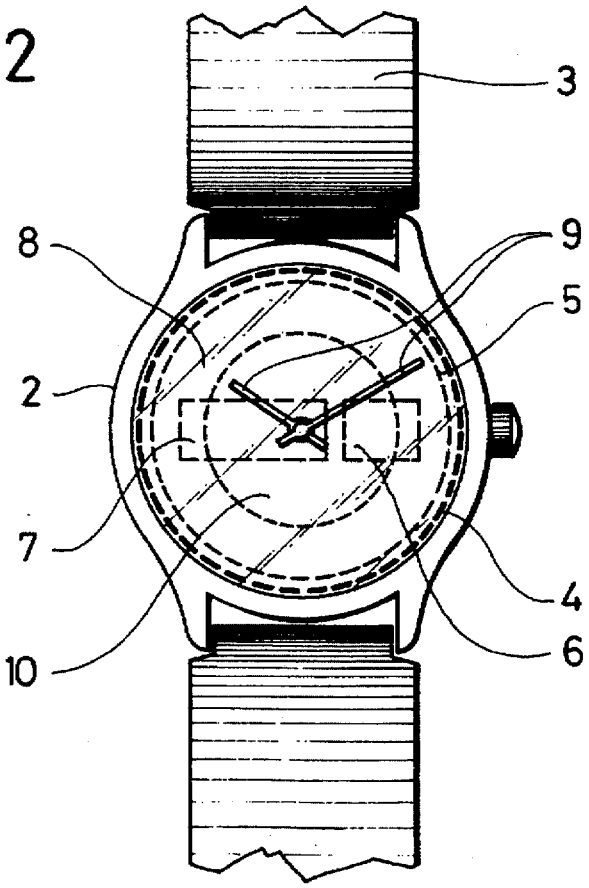
FIG. 2 is a plan view of the horlogical piece of FIG. 1.

FIG. 2 is a plan view of the wrist watch 1 comprising the case 2, the bracelet 3 and the antenna 4. The wrist watch 1 further comprises a supplementary case 5, which is located in the case 2. A micro emitter receiver 6 is disposed in the case 5 as well as organs for displaying the time comprising notably a movement 7, a dial 8, hands 9 and a supply 10. The micro emitter receiver 6 is connected to the antenna 4 such that it receives or emits messages via this latter and then transforms these messages into data perceptible to the user of the wrist watch 1, for example, by emitting audible signals.

Figure 3:
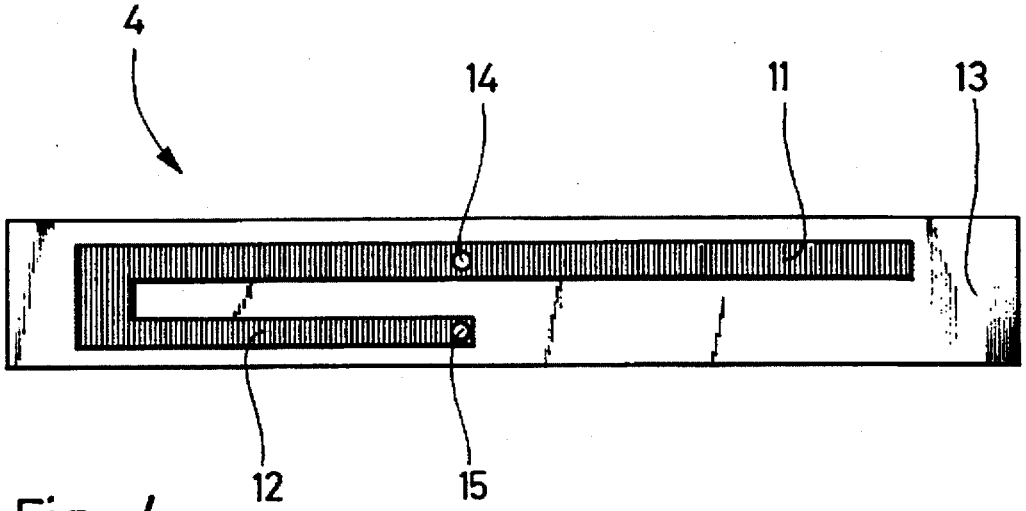
FIG. 3 is a plan view of a first embodiment of an antenna forming part of the horlogical piece of FIG. 1.

Referring now to FIG. 3, it can be seen that antenna 4 includes printed circuits conductive elements 11 and 12 fixed to a dialectric substrate 13. In addition, to facilitate the assembly of the antenna in the horlogical piece of the invention, the substrate 13 is preferably flexible. For example, it has been determined that the materials Kapton® and Espanex®, which are both commercially available, are suitable in this regard.

The conductive element defined the dipole. Preferably, this dipole has a length of approximately ½, where λ is the wave length of the electromagnetic signal that the antenna is attended to receive or emit. The conductive element 12 forms a compensation arm which is added to this dipole. The length of the arm is adjusted such that the impedance of the antenna is adapted to a transmission line which connect the antenna 1 of the micro emitter receiver 6 located in the case of horlogical piece of the invention.

The connection between the antenna 4 and this transmission line is made at two excitation points 14 and 15, respectively half way along the conductive element 11 and on the conductive element 12. These conductive elements 11 and 12 are preferably constituted by a metallic deposition, for example, of copper, on the dielectric substrate 31.

Figure 4:
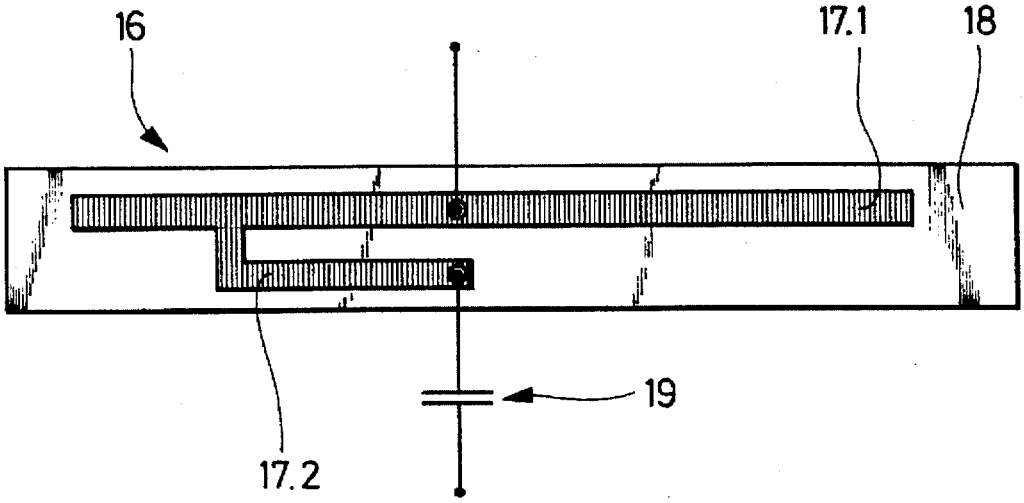
FIG. 4 is plan view of a second embodiment of an antenna forming part of the horlogical piece of FIG. 1.

FIG. 4 shows a variant of the antenna of FIG. 3. This figure shows that the antenna 16 comprises printed circuit conductive elements 17.1 and 17.2 fixed to the dielectric substrate 18.

The conductive element 17.1 forms a dipole. Preferentially, this dipole has a length of approximately ½. The conductive element 17.2 forms a compensation arm which is added to this dipole. One plate of a capacitor 19 is connected to the end of the conductive element 17.2 so is to form with this later a gamma adaptation connection between the dipole 17.1 and the transmission line which connect the antenna 1 to the micro receiver 6. The connection between the antenna 16 and the transmission line is made ad two excitation points, respectively half way along the conductive element 17.1 and the other place of the capacitor 19.

Figure 5:
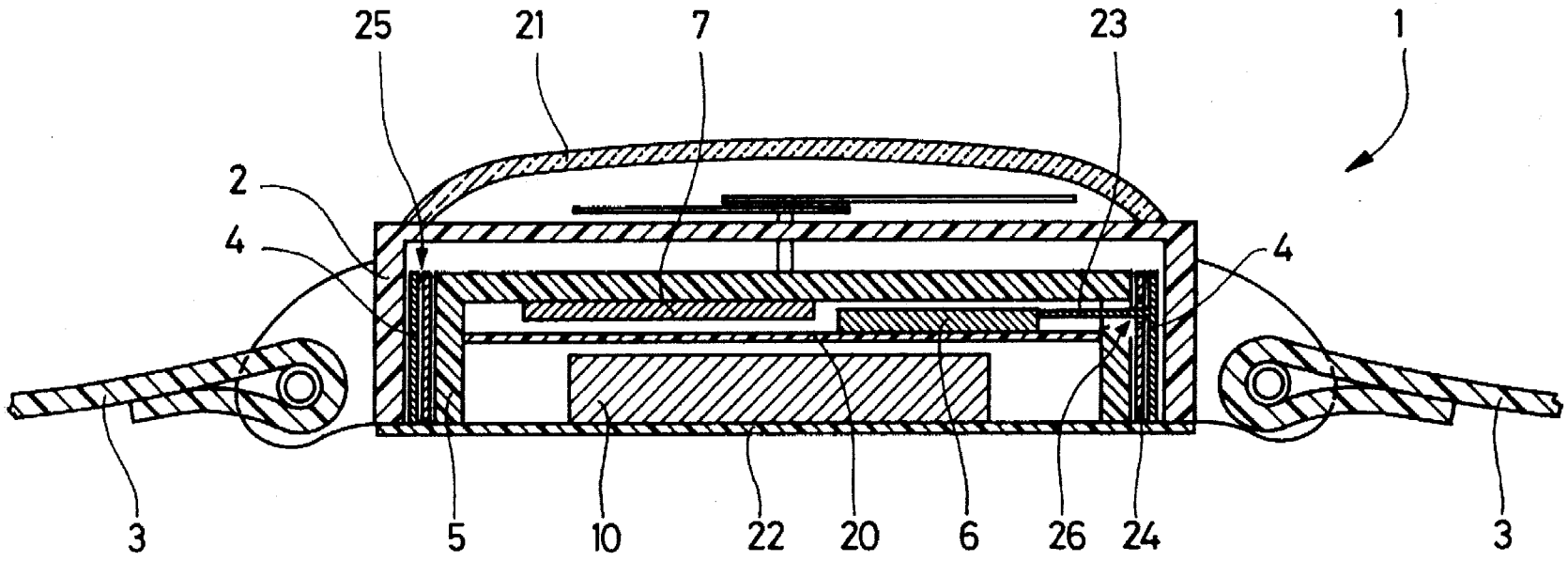
FIG. 5 is a cross-sectional view of the horlogical piece of FIG. 2.

FIG. 5 is a cross sectional of view of the wrist watch 1. The horlogical piece 1 includes the dipole antenna 4 of FIG. 3 as well as the two cases 2 and 5, the horlogical movement 7, the micro receiver 6 and the pile supply 10 of FIG. 2. The horlogical piece 1 further comprises a printed circuit board 20 mounted in the case 5, a crystal 21, a bottom 22 and a transmission line 23. The micro emitter receiver 6 is mounted on the printed circuit board 20. The micro emitter receiver 6 and the movement 7 are powered by the portable power source 10.

Figure 6:
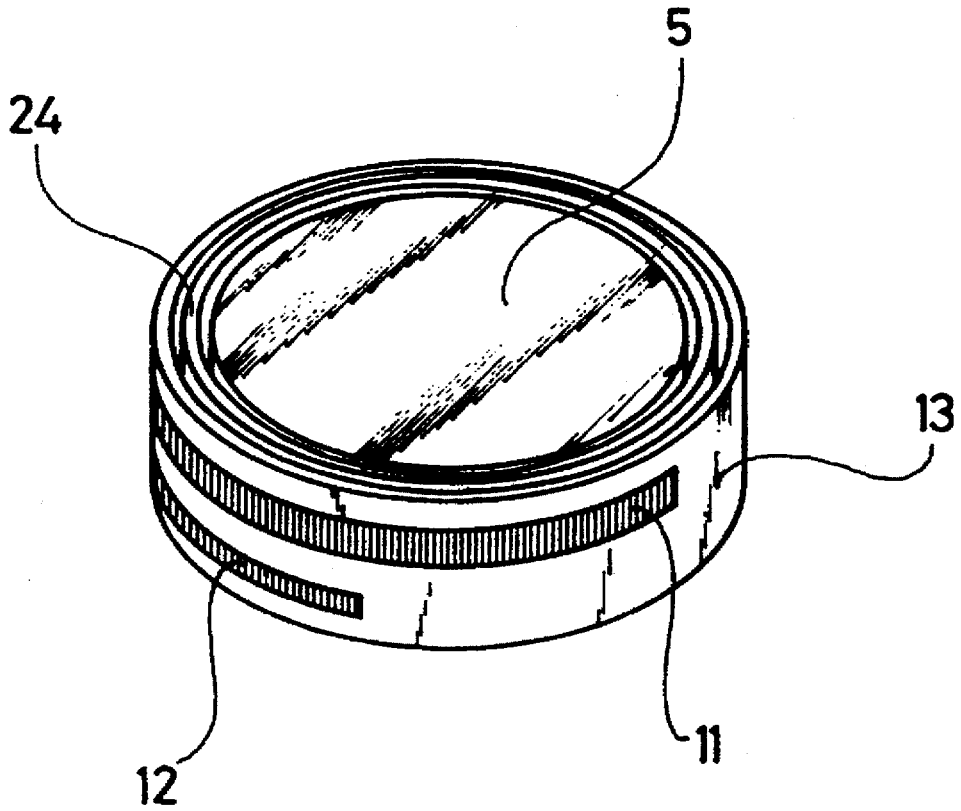
FIG. 6 is a perspective view of the antenna of FIG. 3 rolled around the first case of the horlogical piece of FIG. 5.

The case 2 is intended to receive the case 5 such that the exterior surface of the case 5 and the interior surface of the case 2 defined a mounting slot 25. As can be seen in FIG. 6, the antenna 4 is located in the mounting slot 25 such that it is wound around the case 5.

The arrangement which is just been described enables the antenna to be fabricated independently of the other elements of the horlogical piece. This facilitates the fabrication not only of the antenna but also of the horlogical piece as such.

Moreover, this arrangement enables the facilitation of the housing of the antenna during its assembly in the horlogical piece so is to benefit from the inherent dimension of this later and to be able to optimise the electrical dimensions of the antenna.

Preferably, as can be seen on FIGS. 3, 4 and 5, the surface of the conductive elements 11 and 12 extend in the direction of the depth of the wrist watch 1, that is to say, in the direction between the crystal and the bottom. Now, the optimisation of the antenna 4 is linked to this surface. The depth of a wrist watch is a dimension which may be relatively easily be modified without affecting to an important extent neither its visual aspect no the eas of it use. Therefore, the disposition of the antenna in this manner enables the optimisation of the antenna in a wrist watch.

The antenna 4 is exited via the transmission 23 which connected the antenna 4 to the micro receiver 6. The transmission 23 is, preferably, constituted by a micro strip track. Alternatively, this transmission line may also be constituted by coaxial cable.

Preferably, the transmission line 23 passes through an opening 26 provide in a lateral wall of the case 5. By approaching the micro receiver 6 to the antenna 4, this arrangement enables the length of the transmission line 23 to be minimised and thus the losses due thereto be minimised.

The wrist watch 1 may also include a ground plate 24. The ground plate 24 is located in the mounting slot 25 between the antenna 4 and the exterior surface of the case 5 such that it surrounds this latter. The ground plate 24 presents the advantage of electrically visullating the antenna 4 from perturbing elements which are found inside the wrist watch 1, for example, metallic masses such that the movement 7, the micro receiver 6 and the power supply 10. Thus, the characteristics of the antenna 4 may be selected without considering the perturbing effects from the interior of the wrist watch 1. One of the advantage is such an arrangement is that enables the use of the same antenna in different horlogical movements.

Figure 7:
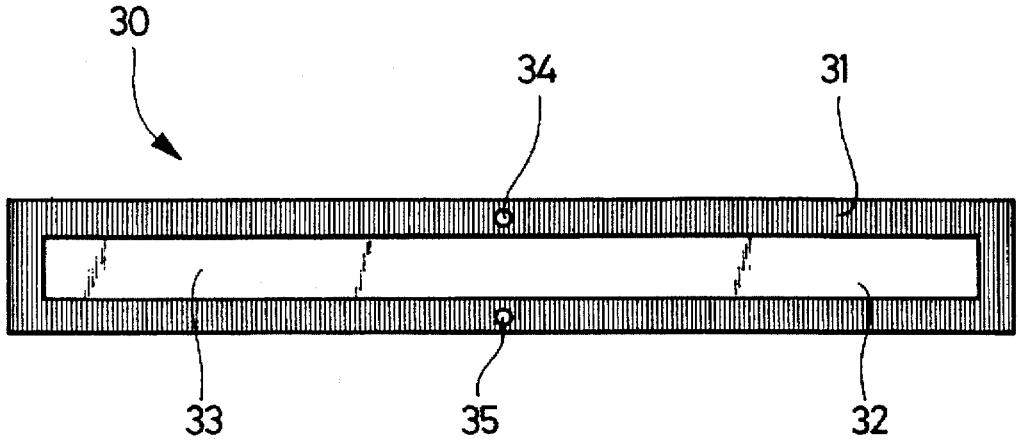
FIG. 7 is a plan view of a third embodiment of the antenna forming part of the horlogical piece of FIG. 2.

FIG. 7 shows a third embodiment of the antenna of the horlogical piece of the invention. This antenna 30 consists of a printed circuit conductive element 31 fixed to a dielectric subtract 32. As as been preciously described, the subtract 32 is preferably constituted by a flexible material. The conductive element 31 is preferably realised by a metallic deposit on a dielectric subtract 32.

A radiating slot 33 is formed in the conductive element 31. A skilled person knows that, according to Babinet principal, this antenna is the dual of a classic dipole antenna, such as the dipole formed by the conductive element 11. Thus, the radiating slot 33 forms the complement of a dipole. Preferably, the slot as a longer of approximately ½, where λ is the wavelength of the electromagnetic signal that the antenna is intended to detect.

The connection between the antenna 30 and the transmission 30 is made at two excitation points 34 and 35, respectively half way along and at opposing sides of the radiating slot 33. If it is necessary, the adaptation of the antenna 30 to the impedance of the transmission line 23 may by made by a capacitive connected between one of the excitation points and one of the conductive of transmission line 23.

Figure 8:
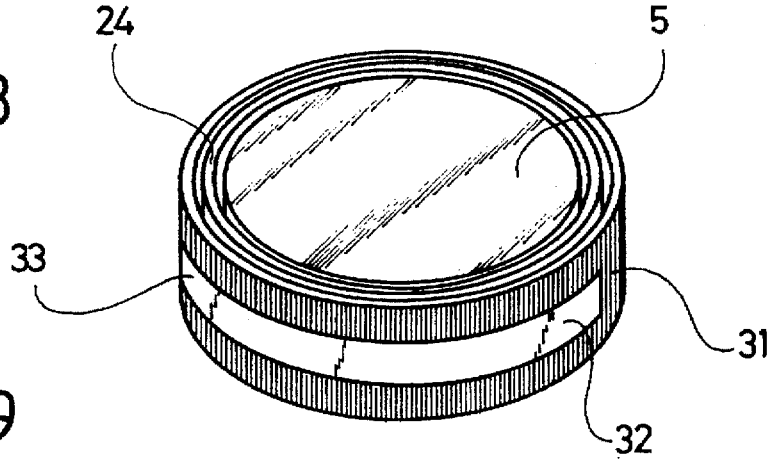
FIG. 8 is perspective view of the antenna of FIG. 6 rolled around the first case of the horlogical piece of figure; and, FIG. 9 is a plan view of a fourth embodiment of the antenna forming part of the horlogical piece of FIG. 2.
Figure 9:
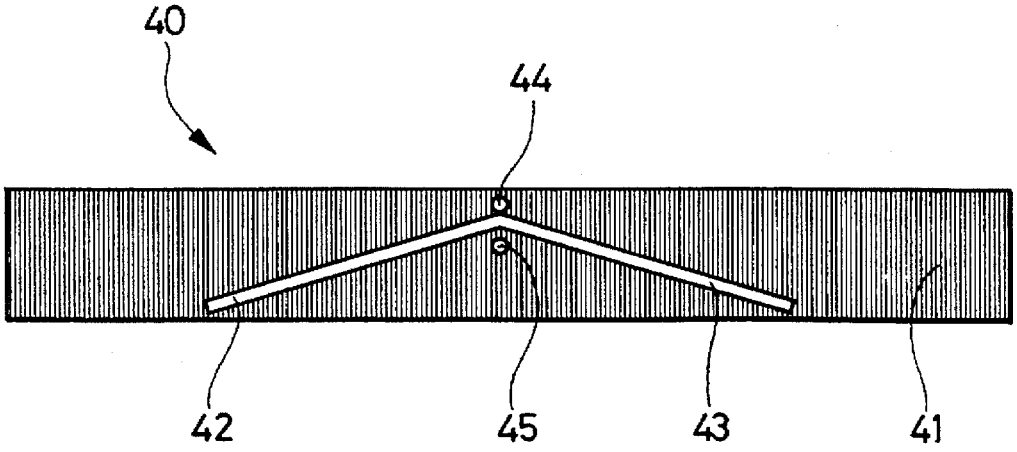

As can be seen in FIG. 8, the antenna 30 is also located in the mounting slot 25 such that it is rolled around the casing 5.

FIG. 8 shows a fourth embodiment of the antenna of the horlogical piece of the invention. As with the antenna 30, the antenna 40 consist of a conductive element 41 fixed to a dielectric subtract 42. This latter is preferably by a flexible material. The conductive element 41 is preferably realised by a metallic deposit on the subtract 32, and defined by a radiating slot 43 formed in the mass 41. Whilst the slot 33 is rectilinear the slot of FIG. 6 has the form of a "V".

The connection between the antenna 40 and the transmission line 23 is maded two excitation point 44 and 45 on opposing size of the point of the "V" of the radiating slot 43. The adaptation of the antenna 40 to the impedance of the transmission line 23 may also be made by a capacitor connected between one of the excitation points and a wire of the transmission line 23. Such a slot form enables the positioning of the excitation points 44 and 45 in the direction of the depth of the wrist watch 1 so that it is directly facing the micro receiver 6. Thus, the length of the transmission line which connects the antenna 40 to the micro receiver 6 can be minimised.

Finally, it is to be noted that several modifications and/or ameliorations may be made to the horlogical piece according to the invention without departing from domain thereof.

What is claimed is:

1. Horlogical piece intended to be worn on the wrist, comprising:

either a dipole antenna (4) or a radiating slot antenna (30; 40) able to receiver and/or emit an electromagnetic field bearing radio diffused messages, a first casing (5) comprising organs (7, 8, 10) for displaying the time of day, and a micro emitter receiver (6) which receive or emit messages detected by the antenna (4; 30; 40), and a second casing (2) intended to receive said first casing (5) such that the exterior surface of said first casing and the interior surface of said second casing define a mounting slot 25, said antenna (4; 30; 40) comprising a dielectric subtract (13; 33; 43), and at least one printed circuit conductive element (11, 12; 31; 41) fixed to said substrate (13; 33; 43) and which definds a radiating element of said antenna (4; 30; 40), said antenna (4; 30; 40) is located in said mounting slot (25) such that it is wound around said first casing (5).

2. Horlogical piece according to claim 1, wherein it further comprises a ground plate (24) located in said mounting slot between said antenna and the exterior surface of said first casing such that it surrounds the later.

3. Horlogical piece according to claim 1, wherein said dielectric substrate (13; 33; 43) is constituted by a flexible material.

4. Horlogical piece according to claim 1, wherein the surface of said conductive elements extend in the direction of the depth of said piece.

5. Horlogical piece according to claim 1, wherein it further comprises a transmission line (23) which connects said antenna (4; 30; 40) to said micro emitter receiver (6) in that said first casing (5) includes an opening a lateral wall thereof, said transmission line (23) passing through said opening (26) to enable the approaching of said antenna (4; 30; 40) to said micro emitter receiver (5).

6. Horlogical piece according to claim 5, wherein said antenna (16) is constituted by two conductive elements (17.1, 17.2) and a capacitor (19) connected to a first of said conductive elements so as to form a gamma adaptation connection between the second of said conductive elements and said transmission line (23).

* * * * *